US011512699B1

(12) United States Patent
Furukawa et al.

(10) Patent No.: US 11,512,699 B1
(45) Date of Patent: Nov. 29, 2022

(54) COMPRESSOR AND AIR CONDITIONER

(71) Applicants: KABUSHIKI KAISHA TOSHIBA, Tokyo (JP); Toshiba Carrier Corporation, Kawasaki (JP)

(72) Inventors: Ryo Furukawa, Kawasaki (JP); Shinya Kudo, Yokohama (JP)

(73) Assignees: KABUSHIKI KAISHA TOSHIBA, Tokyo (JP); Toshiba Carrier Corporation, Kawasaki (JP)

( * ) Notice: Subject to any disclaimer, the term of this patent is extended or adjusted under 35 U.S.C. 154(b) by 0 days.

(21) Appl. No.: 17/654,467

(22) Filed: Mar. 11, 2022

(30) Foreign Application Priority Data

Aug. 31, 2021 (JP) ..... JP2021-140935

(51) Int. Cl.

| | |
|---|---|
| ***F04C 23/00*** | (2006.01) |
| ***F04C 18/356*** | (2006.01) |
| ***F04C 18/324*** | (2006.01) |
| ***F04C 29/06*** | (2006.01) |
| ***F04C 29/12*** | (2006.01) |

(52) U.S. Cl.
CPC ..... *F04C 23/008* (2013.01); *F04C 18/356* (2013.01); *F04C 29/065* (2013.01); *F04C 29/068* (2013.01); *F04C 29/128* (2013.01); *F04C 2210/26* (2013.01); *F04C 2240/40* (2013.01); *F04C 2240/50* (2013.01)

(58) Field of Classification Search
CPC .... F04C 23/008; F04C 18/356; F04C 18/324; F04C 29/065; F04C 29/068; F04C 29/128
See application file for complete search history.

(56) References Cited

U.S. PATENT DOCUMENTS 5,035,050 A * 7/1991 Cowen ..... F04C 29/128 29/428
6,227,825 B1 * 5/2001 Vay ..... F04B 39/1073 137/15.19
6,468,060 B1 * 10/2002 Dormer ..... F04B 39/1073 137/856

FOREIGN PATENT DOCUMENTS

| | | | |
|---|---|---|---|
| EP | 2 942 526 | A1 | 11/2015 |
| JP | 63-21791 | U | 2/1988 |
| JP | 11-141474 | A | 5/1999 |
| JP | 2004-300975 | A | 10/2004 |
| JP | 2009-243317 | A | 10/2009 |
| JP | 2011-220225 | A | 11/2011 |
| JP | 2012-193687 | A | 10/2012 |
| JP | 6161923 | B2 | 7/2017 |

* cited by examiner

*Primary Examiner* — Deming Wan
(74) *Attorney, Agent, or Firm* — Maier & Maier, PLLC

(57) ABSTRACT

According to one embodiment, a compressor includes cylinders, a rotating shaft, bearings, and discharge valve mechanisms. Each of the discharge valve mechanisms includes a discharge valve and a valve presser. Regarding the valve pressers, each of the valve pressers includes a main body part lengthwise along the longitudinal direction of the discharge valve, and at least one of the valve pressers includes a fixed part extending in a direction intersecting the longitudinal direction of the discharge valve relatively to the main body part and fixed to the bearing.

6 Claims, 12 Drawing Sheets

COMPRESSOR AND AIR CONDITIONER

CROSS-REFERENCE TO RELATED APPLICATIONS

This application is based upon and claims the benefit of priority from Japanese Patent Application No. 2021-140935, filed Aug. 31, 2021, the entire contents of which are incorporated herein by reference.

FIELD

Embodiments described herein relate generally to a compressor and air conditioner including the compressor.

BACKGROUND

A refrigerating cycle device such as an air conditioner or the like is equipped with a compressor configured to compress the refrigerant. The compressor includes, as main components, for example, an electric-motor unit configured to rotate, for example, a rotating shaft, compression-mechanism unit coupled to the electric-motor unit through the rotating shaft, and airtight container accommodating therein the electric-motor unit and compression-mechanism unit. The electric-motor unit includes, for example, a so-called inner-rotor type motor and includes a rotor firmly fixed to the rotating shaft and stator fixed to the inner circumferential part of the airtight container. The rotating shaft includes crank parts (eccentric parts). The compression-mechanism unit includes cylinders each forming, for example, cylinder chambers, and rollers fitted onto the eccentric parts of the rotating shaft and eccentrically rotated inside the cylinder chambers. The inside of the cylinder chamber is partitioned into a suction chamber and compression chamber of the refrigerant with a vane. The rotating shaft is rotatably supported with bearings. The bearing includes a flange part defining a surface in the cylinder chamber in the axial direction of the rotating shaft, and boss part extending in a cylindrical form from the flange part. Further, a muffler configured to suppress pulsation and noise caused by the refrigerant to be compressed by the cylinder of the compression-mechanism unit and discharged into the airtight container is attached to the bearing.

The flange part includes a discharge port from which the refrigerant compressed by the cylinder is discharged into the airtight container, and discharge valve mechanism configured to control opening/closing of the discharge port. For this reason, the flange part includes a concave part (dug-down part) in which the discharge valve mechanism is to be installed in the vicinity of the discharge port. The dug-down part is formed by digging down one surface in the bearing in the axial direction of the rotating shaft, for example, the top surface of the flange part to a predetermined depth. Accordingly, the dug-down part has a less thickness as compared with other portions of the flange part, and the rigidity thereof is liable to become relatively lower in the bearing. Accordingly, when the rotating shaft is rotated, there is a possibility of the dug-down part being elastically deformed in such a manner as to incline the boss part toward, for example, the flange part. Depending on the degree of such a deformation of the dug-down part, there is a possibility of the support rigidity of the rotating shaft based on the bearings being lowered, and possibility of the rotating shaft causing bending vibration and enhancing the noise.

DETAILED DESCRIPTION

In general, according to one embodiment, a compressor comprises cylinders, a rotating shaft, bearings, and at least one of discharge valve mechanisms. The cylinders compress a refrigerant. A rotating shaft arranges inside the cylinders and includes eccentric parts. Each of bearings includes a flange part defining a surface in the cylinder in an axial direction of the rotating shaft, and a boss part extending in a cylindrical form concentric with the rotating shaft so as to be continuous with the flange part and rotatably supporting the rotating shaft. At least one of the discharge valve mechanisms is arranged in the flange part and includes a discharge valve deformed to be opened when the refrigerant compressed by the cylinder reaches a predetermined discharge pressure and lengthwise in a predetermined direction, and a valve presser suppressing further deformation of the discharge valve when the discharge valve is opened. Regarding the valve pressers, each of the valve pressers includes a main body part lengthwise along the longitudinal direction of the discharge valve, and at least one of the valve pressers includes a fixed part extending in a direction intersecting the longitudinal direction of the discharge valve relatively to the main body part and fixed to the bearing.

An embodiment will be described hereinafter with reference to FIGS. 1 to 6.

Figure 1:
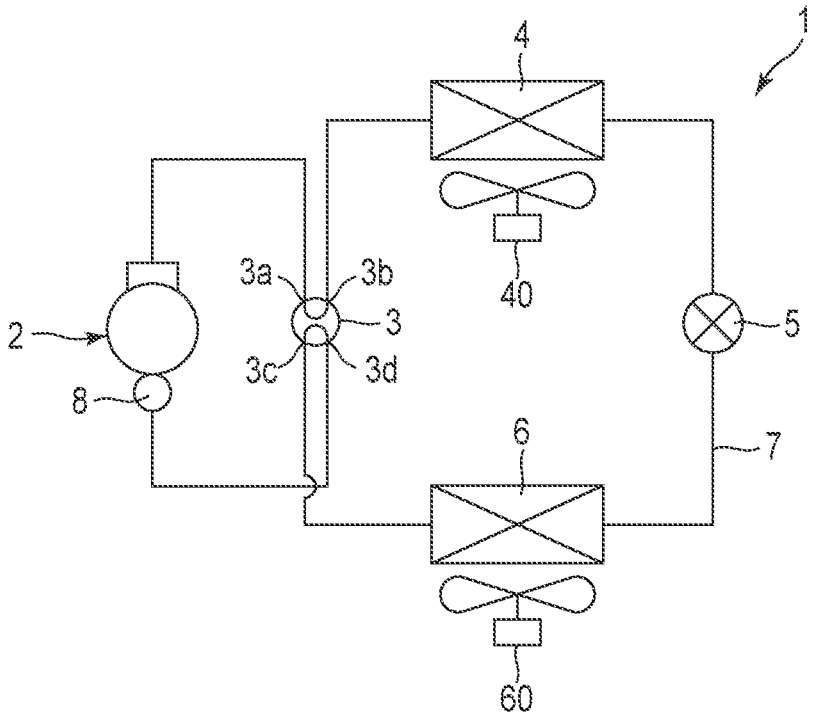
FIG. 1 is a circuit diagram schematically showing the configuration of an air conditioner according to a first embodiment.

FIG. 1 is a refrigerating cycle circuit diagram of an air conditioner 1 according to this embodiment. The air conditioner 1 is a device configured to carry out air conditioning on the basis of such a refrigerating cycle and is an example of the refrigerating cycle device. The air conditioner 1 includes, as main components, a compressor 2, four-way valve 3, outdoor heat exchanger 4, outdoor heat exchanger 4, outdoor air blower 40, expanding device 5, indoor heat exchanger 6, and indoor air blower 60.

As shown in FIG. 1, the discharge side of the compressor 2 is connected to a first port 3*a* of the four-way valve 3. A second port 3*b* of the four-way valve 3 is connected to the outdoor heat exchanger 4. The outdoor heat exchanger 4 is connected to the indoor heat exchanger 6 through the expanding device 5. The indoor heat exchanger 6 is connected to a third port 3*c* of the four-way valve 3. A fourth port 3*d* of the four-way valve 3 is connected to the suction side of the compressor 2 through an accumulator 8.

The refrigerant circulates through a circulation circuit 7 from the discharge side of the compressor 2 to the suction side thereof through the outdoor heat exchanger 4, expanding device 5, indoor heat exchanger 6, and accumulator 8. As the refrigerant, a refrigerant containing no chlorine is desirable and, for example, R448A, R449A, R449B, R407G, R407H, R449C, R456A, R516A, R406B, R463A, R744, and HC-based refrigerant and the like are applicable.

For example, when the air conditioner 1 is operated in the cooling mode, the four-way valve 3 is switched in such a manner that the first port 3*a* communicates with the second port 3*b*, and third port 3*c* communicates with the fourth port 3*d*. When the operation of the air conditioner 1 is started in the cooling mode, the high-temperature/high-pressure vapor-phase refrigerant compressed by the compressor 2 is discharged into the circulation circuit 7. The discharged vapor-phase refrigerant is guided to the outdoor heat exchanger 4 functioning as a condenser (radiator) through the four-way valve 3.

The vapor-phase refrigerant guided to the outdoor heat exchanger 4 is condensed by heat exchange with the air (outside air) sucked by the outdoor air blower 40 and is changed into a high-pressure liquid-phase refrigerant. The high-pressure liquid-phase refrigerant is decompressed in the process of passing through the expanding device 5 and is changed into a low-pressure vapor-liquid two-phase refrigerant. The vapor-liquid two-phase refrigerant is guided to the indoor heat exchanger 6 functioning as an evaporator (heat absorber, heat sink) and carries out heat exchange with the air (inside air) sucked by the indoor air blower 60 in the process of passing through the indoor heat exchanger 6.

As a result of this, the vapor-liquid two-phase refrigerant draws heat from the air to thereby evaporate and change into a low-temperature/low-pressure vapor-phase refrigerant. The air passing through the indoor heat exchanger 6 is cooled by the evaporative latent heat of the liquid-phase refrigerant and is sent to the place to be air-conditioned (cooled) by the indoor air blower 60 as a cool wind.

The low-temperature/low-pressure vapor-phase refrigerant passing through the indoor heat exchanger 6 is guided to the accumulator 8 through the four-way valve 3. When a liquid-phase refrigerant not fully evaporated is mixed into the refrigerant, the refrigerant is separated into the liquid-phase refrigerant and vapor-phase refrigerant at this place. The low-temperature/low-pressure vapor-phase refrigerant separated from the liquid-phase refrigerant is sucked into the compressor 2 from the accumulator 8 and is compressed again by the compressor 2 into a high-temperature/high-pressure vapor-phase refrigerant and is discharged into the circulation circuit 7.

On the other hand, when the air conditioner 1 is operated in the heating mode, the four-way valve 3 is switched in such a manner that the first port 3*a* communicates with the third port 3*c*, and second port 3*b* communicates with the fourth port 3*d*. When the operation of the air conditioner 1 is started in the heating mode, the high-temperature/high-pressure vapor-phase refrigerant discharged from the compressor 2 is guided to the indoor heat exchanger 6 through the four-way valve 3 and is made to carry out heat exchange with the air passing through the indoor heat exchanger 6. In this case, the indoor heat exchanger 6 functions as a condenser.

As a result of this, the vapor-phase refrigerant passing through the indoor heat exchanger 6 condenses by carrying out heat exchange with the air (inside air) sucked by the indoor air blower 60 and changes into a high-pressure liquid-phase refrigerant. The air passing through the indoor heat exchanger 6 is heated by heat exchange with the vapor-phase refrigerant and is sent to the place to be air-conditioned (heated) by the indoor air blower 60 as a warm wind.

The high-temperature liquid-phase refrigerant passing through the indoor heat exchanger 6 is guided to the expanding device 5 and is decompressed in the process of passing through the expanding device 5 and is further changed into a low-pressure vapor-liquid two-phase refrigerant. The vapor-liquid two-phase refrigerant is guided to the outdoor heat exchanger 4 functioning as an evaporator and carries out heat exchange with the air (outside air) sucked by the outdoor air blower 40 to thereby evaporate and change into a low-temperature/low-pressure vapor-phase refrigerant. The low-temperature/low-pressure vapor-phase refrigerant passing through the outdoor heat exchanger 4 is sucked into the compressor 2 through the four-way valve 3 and accumulator 8 and is compressed again by the compressor 2 into a high-temperature/high-pressure vapor-phase refrigerant and is discharged into the circulation circuit 7.

It should be noted that although in this embodiment, the air conditioner 1 is made operable in both the cooling mode and heating mode, the air conditioner 1 may also be a cooling-dedicated device or heating-dedicated device operable in only one of, for example, the cooling mode and heating mode.

Figure 2:
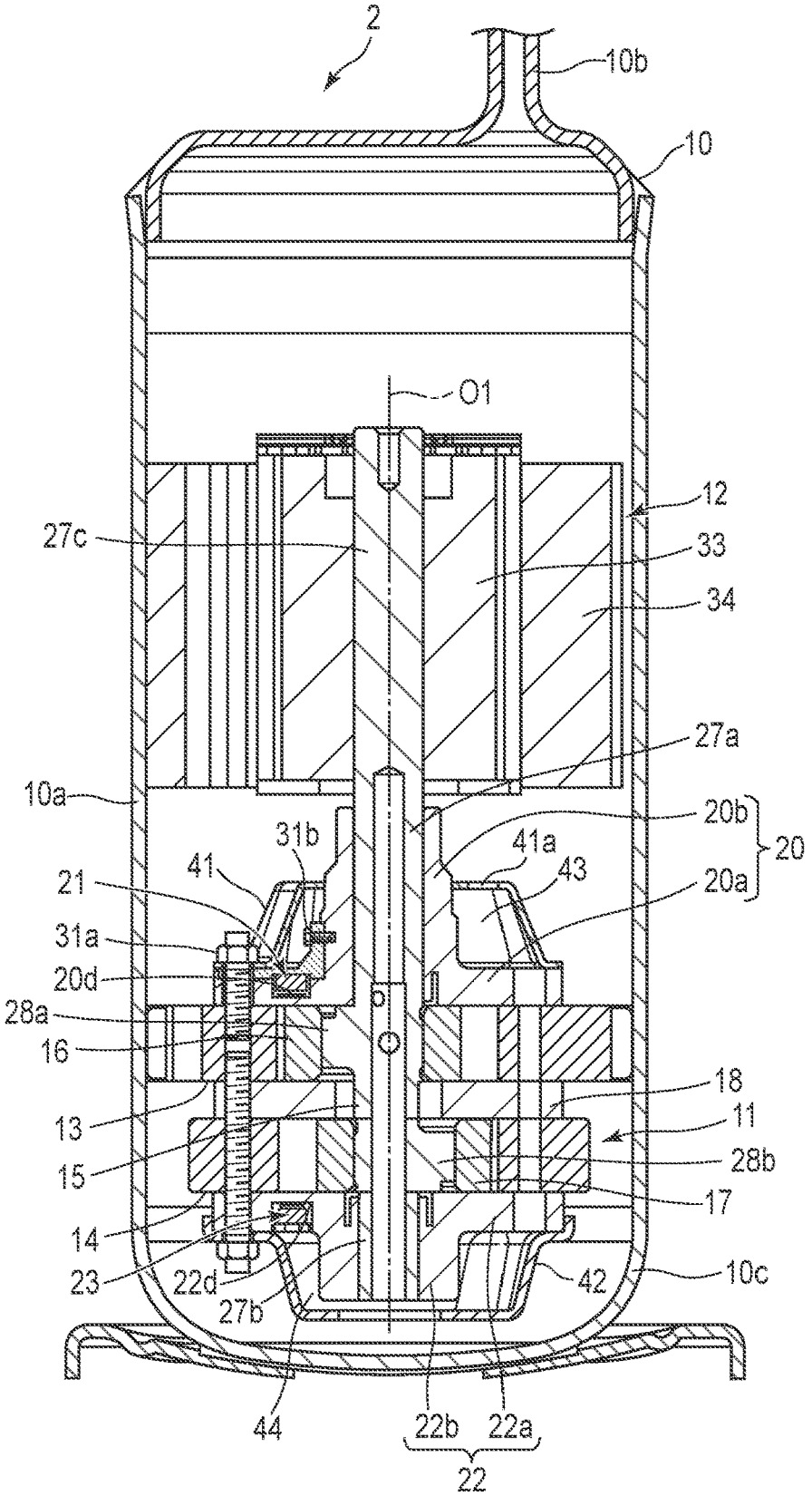
FIG. 2 is a vertical cross-sectional view of a compressor according to the first embodiment.

Next, the specific configuration of the compressor 2 to be used for the air conditioner 1 will be described below with reference to FIG. 2. FIG. 2 is a vertical cross-sectional view of the compressor 2. As shown in FIG. 2, the compressor 2 is a so-called vertical rotary compressor and includes, as main components, an airtight container 10, compression-mechanism unit 11, and electric-motor unit 12. It should be noted that in the following descriptions, on the basis of the relative positional relationship between the compression-mechanism unit 11 and electric-motor unit 12 arranged along the central axis line O1 of the airtight container 10 to be described later, the side on which the compression-mechanism unit 11 is positioned is defined as below, and side on which the electric-motor unit 12 is positioned is defined as above.

The airtight container 10 includes a circumferential wall 10*a* having a cylindrical shape and stands vertical relatively to the installation surface. The installation surface is, for example, a bottom plate or the like of the outdoor unit. At the upper end of the airtight container 10, a discharge pipe 10*b* is provided. The discharge pipe 10*b* is connected to the first port 3*a* of the four-way valve 3 through the circulation circuit 7. At the lower part of the airtight container 10, an oil basin part 10*c* storing therein the lubricating oil is provided.

The compression-mechanism unit 11 is accommodated in the airtight container 10 at the lower part thereof in such a manner as to be immersed in the lubricating oil. In the example shown in FIG. 2, the compression-mechanism unit 11 has a twin-type cylinder structure and includes a first cylinder 13, second cylinder 14, and rotating shaft 15 as main components. Each of the first cylinder 13 and second cylinder 14 includes a roller (rolling piston) and vane inside thereof. It should be noted that the number of the cylinders of the compression-mechanism unit is not limited two, and may be one, or greater than or equal to three.

The first cylinder 13 is fixed to the inner circumferential surface of the circumferential wall 10*a* of the airtight container 10. The second cylinder 14 is fixed to the undersurface of the first cylinder 13 through a partition plate 18.

To the upper part of the first cylinder 13, a first bearing 20 is fixed. The first bearing 20 covers the bore part of the first cylinder 13 from above and upwardly protrudes from the first cylinder 13. The space surrounded by the bore part of the first cylinder 13, partition plate 18, and first bearing 20 constitutes a first cylinder chamber. The partition plate 18 and first bearing 20 respectively correspond to closure members defining the undersurface of the first cylinder chamber and top surface of the first cylinder chamber.

To the lower part of the second cylinder 14, a second bearing 22 is fixed. The second bearing 22 covers the bore part of the second cylinder 14 from below and downwardly protrudes from the second cylinder 14. The space surrounded by the bore part of the second cylinder 14, partition plate 18, and second bearing 22 constitutes a second cylinder chamber. The partition plate 18 and second bearing 22 respectively correspond to closure members defining the top surface of the second cylinder chamber and undersurface of the second cylinder chamber. The first cylinder chamber and second cylinder chamber are arranged concentrically with the central axis line O1 of the airtight container 10.

The first cylinder chamber and second cylinder chamber are connected to the accumulator 8 through a suction pipe (illustration omitted) serving as a part of the circulation circuit 7. The vapor-phase refrigerant separated from the liquid-phase refrigerant by the accumulator 8 is guided to the first cylinder chamber and second cylinder chamber through the aforementioned suction pipe.

The rotating shaft 15 is positioned in such a manner that the central axis thereof is concentric with the central axis line O1 of the airtight container 10, and penetrates the first cylinder chamber, second cylinder chamber, and partition plate 18. The rotating shaft 15 includes a first journal part 27*a*, second journal part 27*b*, and a pair of crankpin parts (eccentric parts) 28*a* and 28*b*. That is, the rotating shaft 15 is configured as a crankshaft. The first journal part 27*a* is rotatably supported by the first bearing 20. The second journal part 27*b* is rotatably supported by the second bearing 22.

Furthermore, the rotating shaft 15 includes an extension part 27*c* concentrically extended from the first journal part 27*a*. The extension part 27*c* penetrates the first bearing 20 to upwardly protrude from the compression-mechanism unit 11. To the extension part 27*c*, a rotor 33 (to be described later) of the electric-motor unit 12 is firmly fixed.

The eccentric parts 28*a* and 28*b* are positioned between the first journal part 27*a* and second journal part 27*b*. The eccentric parts 28*a* and 28*b* respectively have phase differences of, for example, 180° and amounts of eccentricity of the eccentric parts 28*a* and 28*b* relative to the central axis line O1 of the airtight container 10 are made equal to each other. The eccentric part (hereinafter referred to as a first eccentric part) 28*a* on one hand is accommodated in the first cylinder chamber. The eccentric part (hereinafter referred to as a second eccentric part) 28*b* on the other hand is accommodated in the second cylinder chamber.

Rollers 16 and 17 are respectively fitted onto the outer circumferential surfaces of the first eccentric part 28*a* and second eccentric part 28*b*. Between the inner circumferential surface of each of the rollers 16 and 17 and outer circumferential surface of each of the eccentric parts 28*a* and 28*b*, a small gap allowing each of the rollers 16 and 17 to rotate relatively to each of the eccentric parts 28*a* and 28*b* is provided. Thereby, when the rotating shaft 15 rotates, each of the rollers 16 and 17 eccentrically rotates inside the cylinder chamber and part of the outer circumferential surface of each of the rollers 16 and 17 comes into contact with the inner circumferential surface of the cylinder chamber through an oil film.

Inside each of the first cylinder 13 and second cylinder 14, a vane (illustration omitted) is arranged. Each of the vanes is supported by each of the cylinders 13 and 14 in a state where each of the vanes is inwardly impelled in the radial direction by impelling means. The tip end part of each of the vanes is slidably pressed against the outer circumferential surface of each of the rollers 16 and 17. Each of these vanes is configured in such a manner as to partition the cylinder chamber of each of the cylinders 13 and 14 into a suction chamber and compression chamber in cooperation with each of the rollers 16 and 17 and move (advance/retreat) in the direction of protrusion into the cylinder chamber and direction of retreat from the cylinder chamber concomitantly with the eccentric rotation of each of the rollers 16 and 17. Each of the vanes advances/retreats into/from the cylinder chamber as described above, whereby the capacity of each of the suction chamber and compression chamber of the cylinder chamber is changed, and vapor-phase refrigerant sucked into the cylinder chamber from the aforementioned suction pipe is compressed.

The high-temperature/high-pressure vapor-phase refrigerant compressed in each of the cylinder chambers of the first cylinder 13 and second cylinder 14 is discharged into the inside of the airtight container 10 through each of discharge valve mechanisms 21 and 23 to be described later. The discharged vapor-phase refrigerant ascends inside the airtight container 10. Furthermore, while the compression-mechanism unit 11 is in operation, the lubricating oil stored in the oil basin part 10*c* of the airtight container 10 is stirred. The stirred lubricating oil is changed into a mist-like form and ascends inside the airtight container 10 toward the discharge pipe 10*b* under the favor of the flow of the vapor-phase refrigerant. Inside the airtight container 10, an oil separator or the like configured to separate the lubricating oil contained in the vapor-phase refrigerant ascending inside the container 10 from the refrigerant is provided.

The electric-motor unit 12 is accommodated in the airtight container 10 at an intermediate part along the central axis line O1 of the airtight container 10 in such a manner as to be positioned between the compression-mechanism unit 11 and discharge pipe 10*b*. The electric-motor unit 12 includes a so-called inner-rotor type motor and includes a rotor 33 firmly fixed to the rotating shaft 15 and stator 34 fixed to the inner circumferential surface of the circumferential wall 10*a* of the airtight container 10. A voltage is applied to the electric-motor unit 12 from the power source, whereby the rotor 33 is rotated around the central axis line O1 relatively to the stator 34 and rotating shaft 15 is rotated together with the rotor 33. The rotating shaft 15 is rotatably supported by the two bearings 20 and 22.

One of the two bearings 20 and 22 is a main bearing (hereinafter referred to as a first bearing) 20 and the other is an auxiliary bearing (hereinafter referred to as a second bearing) 22. Each of the first bearing 20 and second bearing 22 rotatably supports the rotating shaft 15. Further, the first bearing 20 defines the top surface of the first cylinder chamber in the first cylinder 13 and second bearing 22 defines the undersurface of the second cylinder chamber in the second cylinder 14. The top surface is an end face of each of the cylinders 13 and 14 on one end side thereof in the axial direction (direction along the central axis line O1 of the airtight container 10) of the rotating shaft 15, and undersurface is an end face of each of the cylinders 13 and 14 on the other end side thereof in the aforementioned axial direction. In other words, the first bearing 20 corresponds to a member blocking the first cylinder chamber from above, and second bearing 22 corresponds to a member blocking the second cylinder chamber from below.

The first bearing 20 includes a first flange part 20*a* defining the top surface of the first cylinder chamber in the first cylinder 13 and first boss part 20*b* upwardly extending in a cylindrical form so as to be continuous with the first flange part 20*a*.

The first flange part 20*a* is positioned at the lower end of the first boss part 20*b*, extends toward the outside of the first boss part 20*b* in the radial direction thereof, and is continuous throughout the entire circumference of a circular shape concentric with the central axis of the rotating shaft 15. In the first flange part 20*a*, a discharge hole (hereinafter referred to as a first discharge hole) 20*c* (see FIG. 3) through which the refrigerant is discharged from the compression chamber of the first cylinder 13 is formed. The first discharge hole 20*c* penetrates a part of the first flange part 20*a* in the vertical direction and communicates with the inside of the compression chamber of the first cylinder 13. The first discharge hole 20*c* is opened/closed by a predetermined valve mechanism (hereinafter referred to as a first discharge valve mechanism) 21. The first discharge valve mechanism 21 is arranged in the first flange part 20*a*, opens the first discharge hole 20*c* concomitantly with an increase in the pressure inside the compression chamber of the first cylinder 13 to thereby discharge the high-temperature/high-pressure vapor-phase refrigerant from the compression chamber.

The first boss part 20*b* is a part into which the rotating shaft 15, more specifically, the first journal part 27*a* is inserted at the first bearing 20, and which rotatably supports the first journal part 27*a*. The first boss part 20*b* is arranged so as to be concentric with the rotating shaft 15. That is, the first boss part 20*b* is arranged perpendicular to the first flange part 20*a*. In the state where the first journal part 27*a* is inserted into the first boss part 20*b*, the outer circumferential surface thereof is slid along the inner circumferential surface of the first boss part 20.

The second bearing 22 includes a second flange part 22*a* defining the undersurface of the second cylinder chamber in the second cylinder 14 and second boss part 22*b* downwardly extending in a cylindrical form so as to be continuous with the second flange part 22*a*.

The second flange part 22*a* is positioned at the upper end of the second boss part 22*b*, extends toward the outside of the second boss part 22*b* in the radial direction thereof, and is continuous throughout the entire circumference of a circular shape concentric with the central axis of the rotating shaft 15. In the second flange part 22*a*, a discharge hole (illustration omitted, hereinafter referred to as a second discharge hole) through which the refrigerant is discharged from the compression chamber of the second cylinder 14 is formed. The second discharge hole penetrates a part of the second flange part 22*a* in the vertical direction and communicates with the inside of the compression chamber of the second cylinder 14. The second discharge hole is opened/closed by a predetermined valve mechanism (hereinafter referred to as a second discharge valve mechanism) 23. The second discharge valve mechanism 23 opens the second discharge hole concomitantly with an increase in the pressure inside the compression chamber of the second cylinder 14 to thereby discharge the high-temperature/high-pressure vapor-phase refrigerant from the compression chamber.

The second boss part 22*b* is a part into which the rotating shaft 15, more specifically, the second journal part 27*b* is inserted at the second bearing 22, and which rotatably supports the second journal part 27*b*. The second boss part 22*b* is arranged so as to be concentric with the rotating shaft 15. That is, the second boss part 22*b* is arranged perpendicular to the second flange part 22*a*. In the state where the second journal part 27*b* is inserted into the second boss part 22*b*, the outer circumferential surface thereof is slid along the inner circumferential surface of the second boss part 22*b*.

On the first bearing 20, a muffler (hereinafter referred to as a first muffler) 41 configured to cover the first bearing 20 is provided. The first muffler 41 suppresses pulsation and noise caused by, for example, the refrigerant to be discharged from the compression chamber of the first cylinder 13 into the inside of the airtight container 10. The first muffler 41 covers the first bearing 20 so as to surround the part between the first flange part 20*a* and first boss part 20*b*, and forms a first muffler chamber 43 between the first flange part 20*a* and first boss part 20*b*. The first muffler chamber 43 is a space into which the high-temperature/high-pressure refrigerant compressed in the compression chamber of the first cylinder 13 is discharge from the first discharge hole 20*c* in the first place. The first muffler 41 includes communicating holes 41*a* configured to make the inside and outside (space above and below the first muffler wall) of the first muffler 41 communicate with each other. The high-temperature/high-pressure vapor-phase refrigerant discharged into the first muffler chamber 43 through the first discharge hole 20*c* is discharged into the inside of the airtight container 10 through the communicating holes 41*a*.

Under the second bearing 22, a muffler (hereinafter referred to as a second muffler) 42 configured to cover the second bearing 22 is provided. The second muffler 42 suppresses pulsation and noise caused by, for example, the refrigerant to be discharged from the compression chamber of the second cylinder 14 into the inside of the airtight container 10. The second muffler 42 covers the second bearing 22 so as to surround the part between the second flange part 22*a* and second boss part 22*b*, and forms a second muffler chamber 44 between the second flange part 22*a* and second boss part 22*b*. The second muffler chamber 44 is a space into which the high-temperature/high-pressure refrigerant compressed in the compression chamber of the second cylinder 14 is discharge from the second discharge hole in the first place. The second muffler chamber 44 communicates with the first muffler chamber 43 through a communicating hole provided in the compression-mechanism unit 11. The communicating hole penetrates each of the second flange part 22*a*, second cylinder 14, partition plate 18, first cylinder 13, and first flange part 20*a* and is opened to the second muffler chamber 44 and first muffler chamber 43. The high-temperature/high-pressure vapor-phase refrigerant discharged into the second muffler chamber 44 through the second discharge hole reaches the first muffler chamber 43 through the aforementioned communicating hole and is thereafter discharged into the inside of the airtight container 10 through the communicating holes 41*a*.

Figure 3:
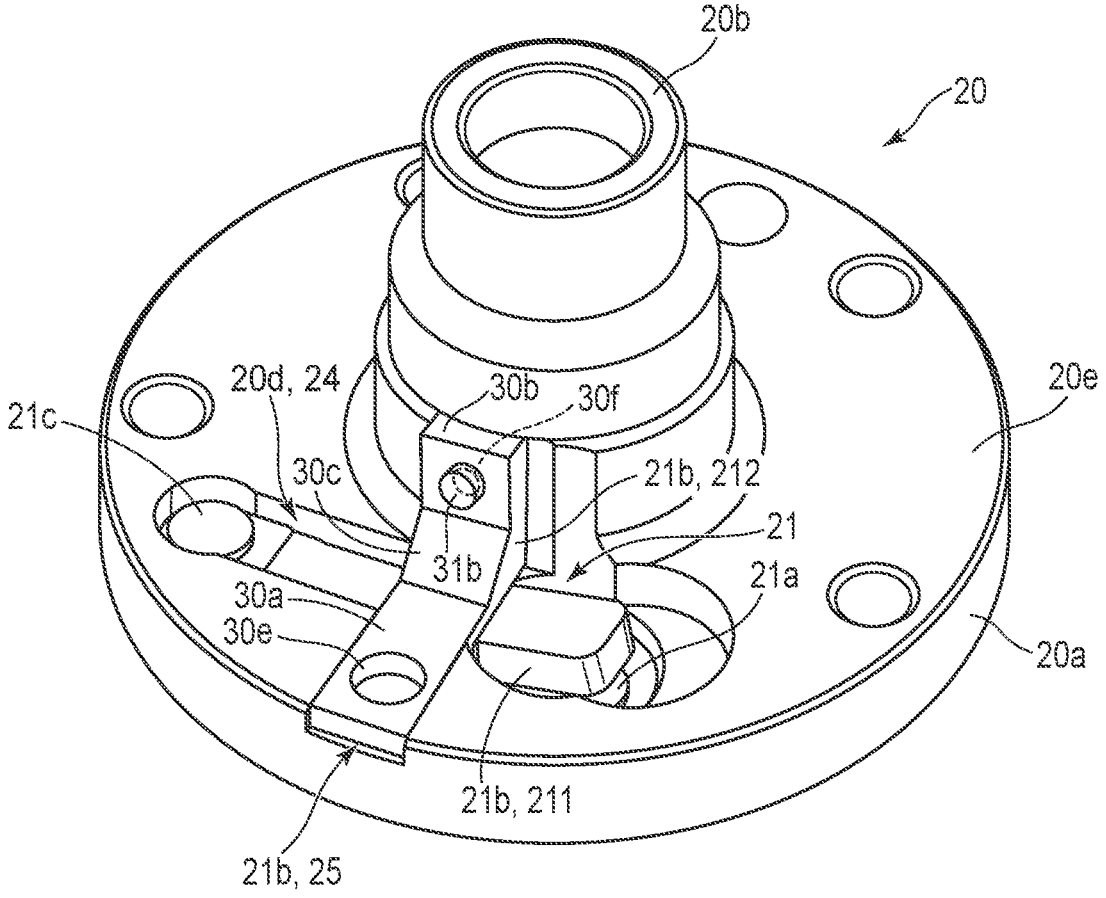
FIG. 3 is a perspective view schematically showing a bearing (first bearing) including a discharge valve mechanism (first discharge valve mechanism) according to the first embodiment.
Figure 4:
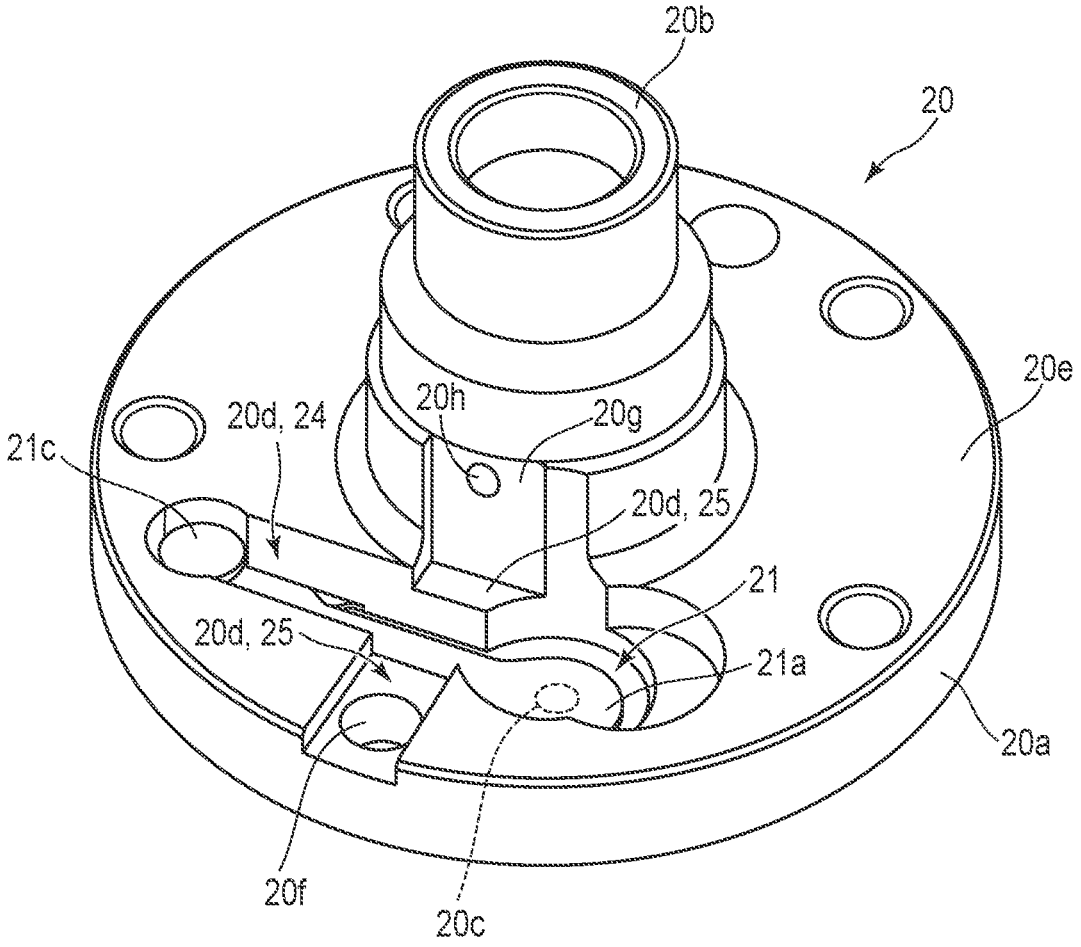
FIG. 4 is a perspective view schematically showing a state where only a discharge valve of the discharge valve mechanism (first discharge valve mechanism) is arranged in FIG. 3.
Figure 5:
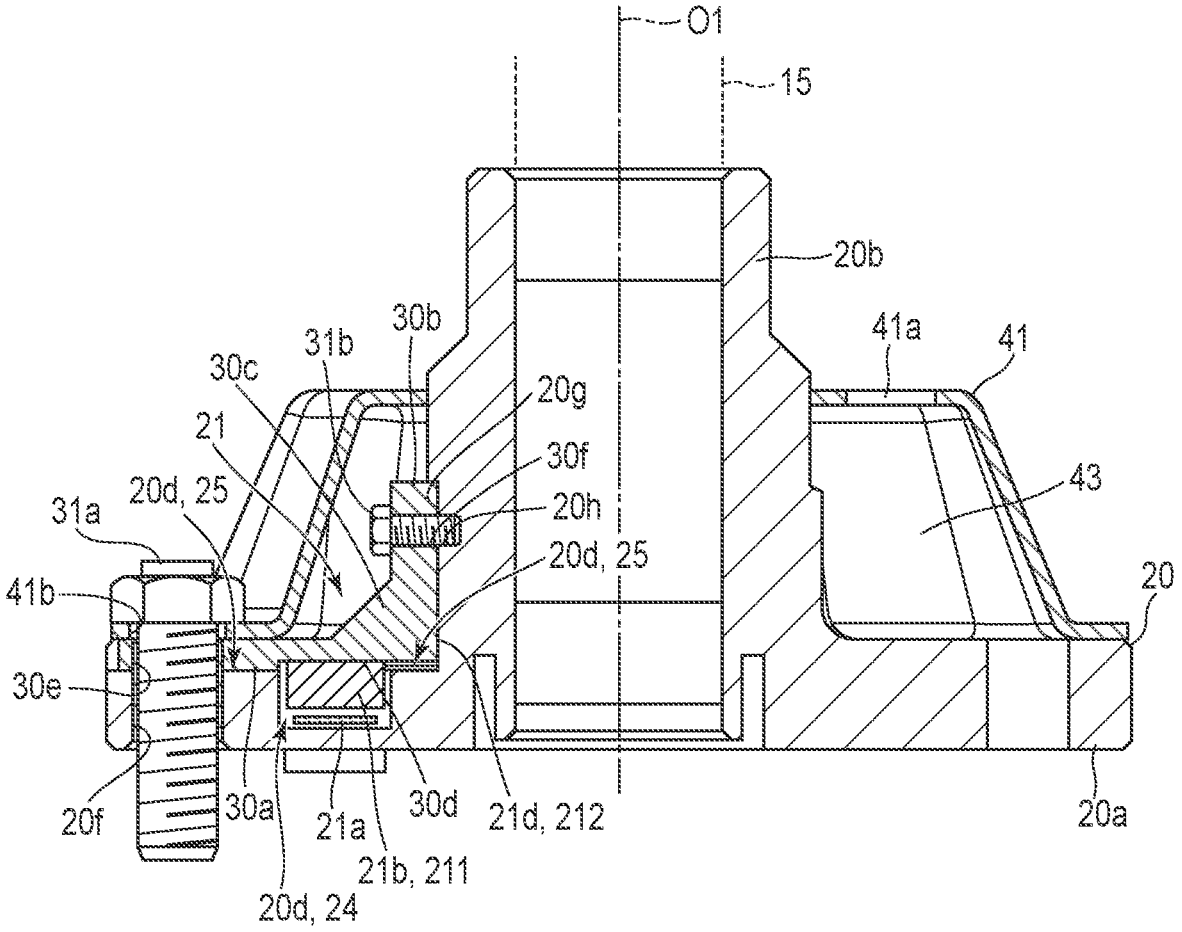
FIG. 5 is a view schematically showing a cross section of the bearing (first bearing) including the discharge valve mechanism (first discharge valve mechanism) according to the first embodiment.

In FIGS. 3 to 5, the configuration of the first discharge valve mechanism 21 is shown. FIG. 3 is a perspective view schematically showing the first bearing 20 including the first discharge valve mechanism 21. FIG. 4 is a perspective view schematically showing a state where only a discharge valve 21*a* of the first discharge valve mechanism 21 is arranged in FIG. 3. FIG. 5 is a cross-sectional view schematically showing the first bearing 20.

As shown in FIGS. 3 to 5, the first discharge valve mechanism 21 is provided in the first flange part 20*a* of the first bearing 20, appropriately opens the first discharge hole 20*c* to thereby discharge the refrigerant compressed in the compression chamber of the first cylinder 13 from the compression chamber. The first discharge valve mechanism 21 includes a discharge valve 21*a* and valve presser 21*b*.

The first discharge hole 20*c* is opened at the bottom of a concave part (hereinafter referred to as a dug-down part) 20*d* formed in the first flange part 20*a*. The dug-down part 20*d* is formed by digging down the top surface (end face on one end side in the axial direction of the rotating shaft 15) 20*e* of the first flange part 20*a* to a predetermined depth. In other words, the dug-down part 20*d* is formed in the first flange part 20*a* as a concave part in which the first discharge valve mechanism 21 is to be installed.

The dug-down part 20*d* includes a first part 24 and second part 25 each of which is lengthwise in the predetermined direction.

In the dug-down part 20*d*, the first part 24 is a concave part in which the discharge valve 21*a* of the first discharge valve mechanism 21 and main body part 211 (to be described later) of the valve presser 21*b* of the first discharge valve mechanism 21 are to be installed. Accordingly, the first part 24 is formed so as to have a depth and contour each enabling the discharge valve 21*a* and main body part 211 of the first discharge mechanism 21 to be installed therein. The contour is the shape of an outline of the first part 24 viewed from above the first flange part 20*a*. In this embodiment, in the state where the discharge valve 21*a* and valve presser 21*b* are installed in the first part 24, the discharge valve 21*a* and valve presser 21*b* enter the state where the discharge valve 21*a* and valve presser 21*b* are fully hidden in the first part 24. Further, the concave part corresponding to the first part 24 includes a bottom of the dug-down part 20*d*, the bottom being the part at which the first discharge hole 20*c* is opened.

On the other hand, the second part 25 is, in the dug-down part 20*d*, a concave part in which a fixed part (to be described later) 212 of the valve presser 21*b* of the first discharge valve mechanism 21 is to be installed. Accordingly, the second part 25 is formed so as to have a depth and contour each enabling the fixed part 212 of the first discharge valve mechanism 21 to be installed therein. The contour is the shape of an outline of the second part 25 viewed from above the first flange part 20*a*. Further, the second part 25 is arranged so as to be above and adjacent to the first part 24.

The first part 24 and second part 25 are arranged in such a manner that the longitudinal directions of the parts 24 and 25 are made to intersect each other. In the example shown in FIGS. 3 to 5, the longitudinal directions of the first part 24 and second part 25 are made to intersect each other at right angles. The longitudinal direction of the second part 25 is a radial direction of the first flange part 20*a*, in other words, a direction intersecting the central axis of the rotating shaft 15 at right angles in a plane including the aforementioned central axis. The longitudinal direction of the first part 24 is a direction intersecting the radial direction of the first flange part 20*a* at right angles, in other words, a direction intersecting the plane including the central axis of the rotating shaft 15 at right angles.

The discharge valve 21*a* is a member configured to close or open the first discharge hole 20*c*, and has a plate-like shape lengthwise in the predetermined direction. The discharge valve 21*a* is formed of a material capable of elastic deformation such as spring steel or the like into an oblong card-like shape. An end of the discharge valve 21*a* in the longitudinal direction thereof is fixed to the first flange part 20*a* with a fixing member 21*c*. As the fixing member 21*c*, an arbitrary fixing member such as a bolt, screw, rivet or the like is applied. Thereby, the discharge valve 21*a* is made to have a cantilever leaf spring structure capable of flexure deformation in the state where one end thereof in the longitudinal direction fixed by a fixing member 21*c* is made the fixed end, and the other end thereof in the longitudinal direction is made the free end. More specifically, when the high-temperature/high-pressure vapor-phase refrigerant compressed in the compression chamber of the first cylinder 13 reaches the predetermined discharge pressure, the discharge valve 21*a* undergoes deformation and opens the first discharge hole 20*c*. Hereinafter, this state of the discharge valve 21*a* is referred to as the deformed state. In the state (hereinafter referred to as the normal state) before the first discharge hole 20*c* is opened, the discharge valve 21*a* is in pressure contact with the circumferential edge of the first discharge hole 20*c* in such a manner as to block up the first discharge hole 20*c* by an elastic force (pressing force) less than the aforementioned predetermined discharge pressure. Accordingly, when the refrigerant exceeds the ambient pressure inside the first muffler 41 to reach the predetermined discharge pressure, the discharge pressure deforms the discharge valve 21*a* against the elastic force (pressing force) thereof to thereby make the discharge valve 21*a* open the first discharge hole 20*c* and discharge the refrigerant. When the first discharge hole 20*c* is opened to discharge the refrigerant and discharge pressure of the refrigerant becomes lower than the predetermined pressure, the discharge valve 21*a* is elastically restored from the deformed state to the normal state and blocks up the first discharge hole 20*c* again.

Figure 6:
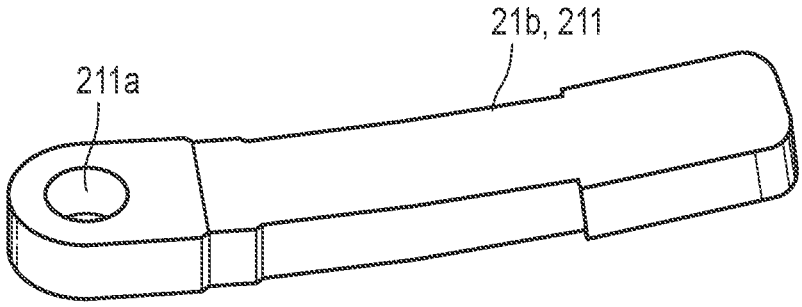
FIG. 6 is a perspective view schematically showing a main body part (valve presser piece) of a valve presser in the discharge valve mechanism (first discharge valve mechanism) according to the first embodiment.
Figure 7:
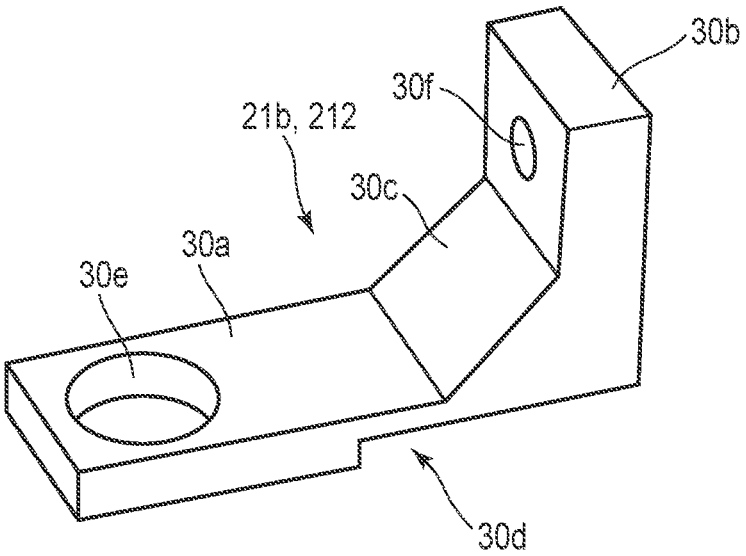
FIG. 7 is a perspective view schematically showing a fixed part (fixed piece) of the valve presser in the discharge valve mechanism (first discharge valve mechanism) according to the first embodiment.

In FIG. 6 and FIG. 7, the valve presser 21*b* is schematically shown. The valve presser 21*b* is a member configured to restrain the discharge valve 21*a* from deformation, and includes a main body part 211 and fixed part 212. In this embodiment, as shown in FIG. 6 and FIG. 7, the main body part 211 and fixed part 212 of the valve presser 21*b* are each configured as separate members. That is, the valve presser 21*b* is formed by assembling the main body part 211 and fixed part 212 which are separate members into one member. FIG. 6 is a perspective view schematically showing the main body part (hereinafter referred to as a valve presser piece) 211 of the valve presser 21*b*. FIG. 7 is a perspective view schematically showing the fixed part (hereinafter referred to as a fixed piece) 212 of the valve presser 21*b*.

As shown in FIGS. 3 to 6, the valve presser piece 211 has a plate-like shape lengthwise in the predetermined direction and having a thickness greater than the discharge valve 21*a*. The valve presser piece 211 is a component mainly fulfilling a function of restraining the discharge valve 21*a* from deformation in the valve presser 21*b*. The valve presser piece 211 is formed of, for example, a steel material or the like. The valve presser piece 211 is arranged in such a manner that the longitudinal direction thereof is made along the longitudinal direction of the discharge valve 21*a*. That is, the valve presser piece 211 is lengthwise along the longitudinal direction of the discharge valve 21*a*. These longitudinal directions are directions intersecting the radial direction of the first flange part 20*a*, in other words, directions intersecting a plane including the central axis of the rotating shaft 15. Further, these longitudinal directions are parallel to the longitudinal direction of the first part 24 of the dug-down part 20*d*. In the example shown in FIGS. 3 to 5, the aforementioned longitudinal directions are directions orthogonal to the radial direction of the first flange part 20*a*, in other words, directions orthogonal to the plane including the central axis of the rotating shaft 15. That is, the longitudinal direction of the valve presser piece 211 is parallel to the direction orthogonal to the plane including the central axis of the rotating shaft 15. One end of the valve presser piece 211 in the longitudinal direction thereof is fixed to the first flange part 20*a* together with the discharge valve 21*a* with the fixing member 21*c*. The valve presser piece 211 includes a through-hole 211*a* into which the fixing member 21*c* is to be inserted.

The valve pressing piece 211 is arranged in such a manner as to be in opposition to the discharge valve 21*a* when the discharge valve 21*a* is in the process of making a displacement to a position separate from the first discharge hole 20*c* in order to open the first discharge hole 20*c*. In the example shown in FIG. 3 and FIG. 5, the valve presser piece 211 is arranged above the discharge valve 21*a* so as to cover the discharge valve 21*a*. The valve presser piece 211 exhibits a bent (slightly levitated) state for opening the first discharge hole 20*c*, i.e., a retroflex configuration conforming to the posture of the discharge valve 21*a* in the deformed state (see FIG. 6). Thereby, when the discharge valve 21*a* undergoes flexure deformation and enters the deformed state so as to open the first discharge hole 20*c*, the valve presser piece 211 gets contact with the deformed discharge valve 21*a* to thereby prevent the discharge valve 21*a* from undergoing further deformation (levitation).

The fixed piece 212 is fixed to the first bearing 20, supports the valve presser piece 211, and reinforces the strength of the first flange part 20*a* at the dug-down part 20*d*. In the example shown in FIG. 7, the fixed piece 212 is made a member separate from the valve presser piece 211. As shown in FIG. 3, FIG. 5, and FIG. 7, the fixed piece 212 is configured as a member lengthwise in the predetermined direction and having a thickness greater than the discharge valve 21*a* as in the case of the valve presser 21*b*. The fixed piece 212 is formed of, for example, the same steel material or the like as the valve presser piece 211.

The fixed piece 212 includes a first piece part 30*a* and second piece part 30*b*. The first piece part 30*a* and second piece part 30*b* are continuous with each other with a right angle held between them. At the aforementioned continuous part at which the piece parts 30*a* and 30*b* are continuous with each other, a reinforcing part 30*c* configured to slantingly fill the part between the first piece part 30*a* and second piece part 30 is provided.

The first piece part 30*a* is a part of the fixed piece 212 fixed to the first flange part 20. The first piece part 30*a* has a plate-like shape lengthwise along the top surface 20*e* of the first flange part 20*a*. Further, the first piece part 30*a* outwardly extends in the direction intersecting the longitudinal direction of the discharge valve 21*a* relatively to the valve presser piece 211, in other words, the first piece part 30*a* outwardly extends in the direction intersecting the longitudinal direction of the valve presser piece 211. The first piece part 30*a* is arranged in such a manner as to make the longitudinal direction thereof along the radial direction of the first flange part 20*a*, in other words, along the direction orthogonal to the central axis of the rotating shaft 15 in the plane including the central axis. That is, the longitudinal direction of the first piece part 30*a* is parallel to the direction orthogonal to the central axis of the rotating shaft 15 in the plane including the central axis, i.e., the aforementioned longitudinal direction is parallel to the longitudinal direction of the second part 25 of the dug-down part 20*d*.

The first piece part 30*a* includes a seating face part 30*d* configured to support the valve presser piece 211 thereon. The seating face part 30*d* is a flat face part formed by making a portion (of the first piece part 30*a*) opposable to the valve presser piece 211 have a step relatively to the other portions. The seating face part 30*d* gets contact with the valve presser piece 211 from above, and holds the valve presser piece 211 down to thereby support the valve presser piece 211. Further, the first piece part 30*a* includes a through-hole 30*e* into which a bolt 31*a* is to be inserted. The bolt 31*a* is an example of a fixing member configured to fix the first piece part 30*a* to the first flange part 20*a*. As shown in FIG. 4, the first flange part 20*a* includes a through-hole 20*f* into which the bolt 31*a* is to be inserted. The through-hole 20*f* communicates with the through-hole 30*e*. In this embodiment, as shown in FIG. 2, the first piece part 30*a* is fastened to the first cylinder 13 through the first flange part 20*a* with the bolt 31*a* together with the first muffler 41. The first muffler 41 includes a through-hole 41*b* into which the bolt 31*a* is to be inserted. Thereby, there is no need for an extra bolt configured to fasten the first piece part 30*a* in addition to the bolt configured to fasten the first muffler 41, and the space used to fasten the extra bolt is also made unnecessary.

As shown in FIG. 3, FIG. 5, and FIG. 7, the second piece part 30*b* is a portion of the fixed piece 212 to be fixed to the first boss part 20*b*. The second piece part 30*b* extends along the outer circumference of the first boss part 20*b*. The second piece part 30*b* is arranged in such a manner as to extend along the outer circumference of the first boss part 20*b*, in other words, as to upwardly extend along the central axis of the rotating shaft 15. In the example, shown in FIG. 3, FIG. 5, and FIG. 7, the second piece part 30*b* is made to have a thickness greater than the first piece part 30*a*. The second piece part 30*b* includes a through-hole 30*f* into which a bolt 31*b* is to be inserted. The bolt 31*b* is an example of a fixing member configured to fix the second piece part 30*b* to the first boss part 20*b*. It should be noted that the first boss part 20*b* includes a seating face part 20*g* configured to support the second piece part 30*b* thereon. The seating face part 20*g* is a flat face part formed by making an outer circumferential portion of the first boss part 20*b* opposable to the second piece part 30*b* have a step relatively to the other portions. As shown in FIG. 4, the seating face part 20*g* includes a bolt-hole 20*h* configured to fasten the bolt 31*b* therein. The bolt-hole 20*h* communicates with the through-hole 30*f*.

Accordingly, as shown in FIG. 5, the fixed piece 212 is fixed to the first bearing 20 at a total of two positions, i.e., to the first flange part 20*a* at a position and to the first boss part 20*b* at a position. In other words, the fixed piece 212 is fixed to the first flange part 20*a* with the bolt 31*a* in the direction along the central axis of the rotating shaft 15, and is fixed to the first boss part 20*b* with the bolt 31*b* in the direction along the radial direction of the rotating shaft 15. In the fixed state described above, the fixed piece 212 is arranged in such a manner as to intersect the valve presser piece 211 at right angles, and supports the valve presser piece 211 in the radial direction of the first flange part 20*a*, in other words, in the direction orthogonal to the central axis of the rotating shaft 15 in the plane including the central axis.

As described above, according to this embodiment, it is possible for the fixed piece 212, when the rotating shaft 15 is rotated, to bear the burden of the force attempting to make the dug-down part 20*d* undergo elastic deformation so as to incline the first boss part 20*b* toward, for example, the first flange part 20*a*. That is, the fixed piece 212 functions as a reinforcing member configured to enhance the strength of the first flange part 20*a* at the dug-down part 20*d*. Owing to this, it is possible to suppress the elastic deformation of the dug-down part 20*d*, and suppress such deformation as to incline the first boss part 20*b* toward the first flange part 20*a*. As a result, it becomes possible to reduce the noise caused by, for example, the rotating shaft 15 creating bending vibration.

Here, the configuration of the second discharge valve mechanism 23 can be made approximately equal to the first discharge valve mechanism 21 except for the difference incidental to the point that the mechanism 21 and mechanism 23 are positioned opposite to each other in the vertical direction. However, it is allowable for the second discharge mechanism 23 to have a configuration from which a member corresponding to the fixed piece 212 is omitted. This is due the following reason. As shown in FIG. 2, the second boss part 22*b* of the second bearing 22 has a length in the axial direction of the rotating shaft 15 less than the first boss part 20*b* of the first bearing 20. That is, such a deformation as to incline the second boss part 22*b* toward the second flange part 22*a* hardly occurs to the second boss part 22*b* and, even when deformed, the second boss part 22*b* is not so largely deformed as the first boss part 20*b*. Accordingly, it becomes possible in the second discharge valve mechanism 23 to omit the member corresponding to the fixed piece 212. In consideration of these, the second discharge valve mechanism 23 can be configured in the same manner as the first discharge valve mechanism 21 except for the differences incidental to the point that the second discharge valve mechanism 23 has no member corresponding to the fixed piece 212 and point that the second discharge valve mechanism 23 is positioned opposite (upside down) in the vertical direction to the first discharge valve mechanism 21.

It should be noted that the configuration of the fixed piece 212 in the first discharge valve mechanism 21 is only an example of the fixed part of the valve presser, and is not limited to the first embodiment (example shown in FIG. 3, FIG. 5, and FIG. 7) described above. Accordingly, even when the fixed part has a configuration different from the above configuration, it is possible to make the aforementioned different fixed part function as a reinforcing member configured to enhance the strength of the first flange part 20*a* at the dug-down part 20*d*. Hereinafter, the other configurations of the fixed part will be described as a second embodiment and third embodiment. It should be noted that the fundamental constituent components of the compressor according to each of the second embodiment and third embodiment are identical to the compressor 2 (FIG. 2) according to the first embodiment. For this reason, hereinafter descriptions of the fundamental constituent components will be omitted or simplified, and a point of difference from the first embodiment which is the specific feature of each of the second embodiment and third embodiment will be described in detail. At the time of description, regarding constituent components identical or similar to the first embodiment, reference symbols identical to the first embodiment will be used.

Second Embodiment

Figure 8:
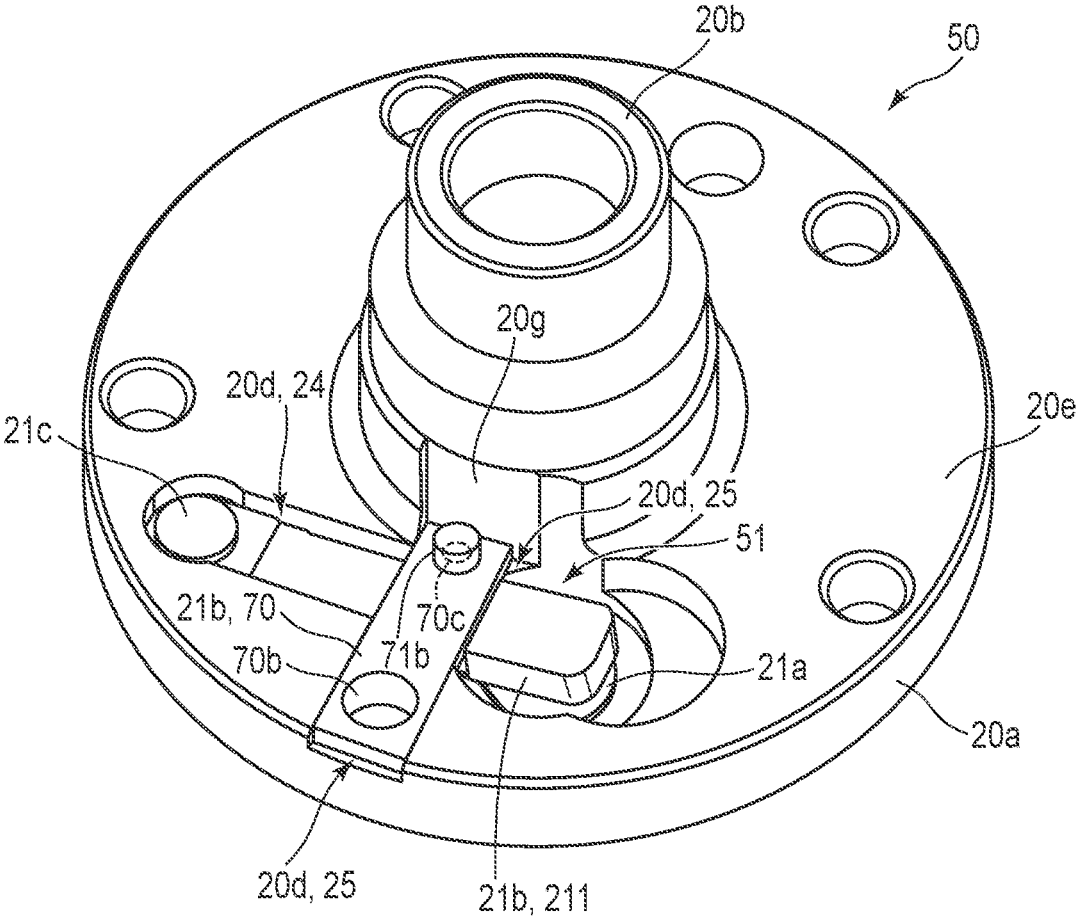
FIG. 8 is a perspective view schematically showing a bearing (first bearing) including a discharge valve mechanism (first discharge valve mechanism) according to a second embodiment.
Figure 9:
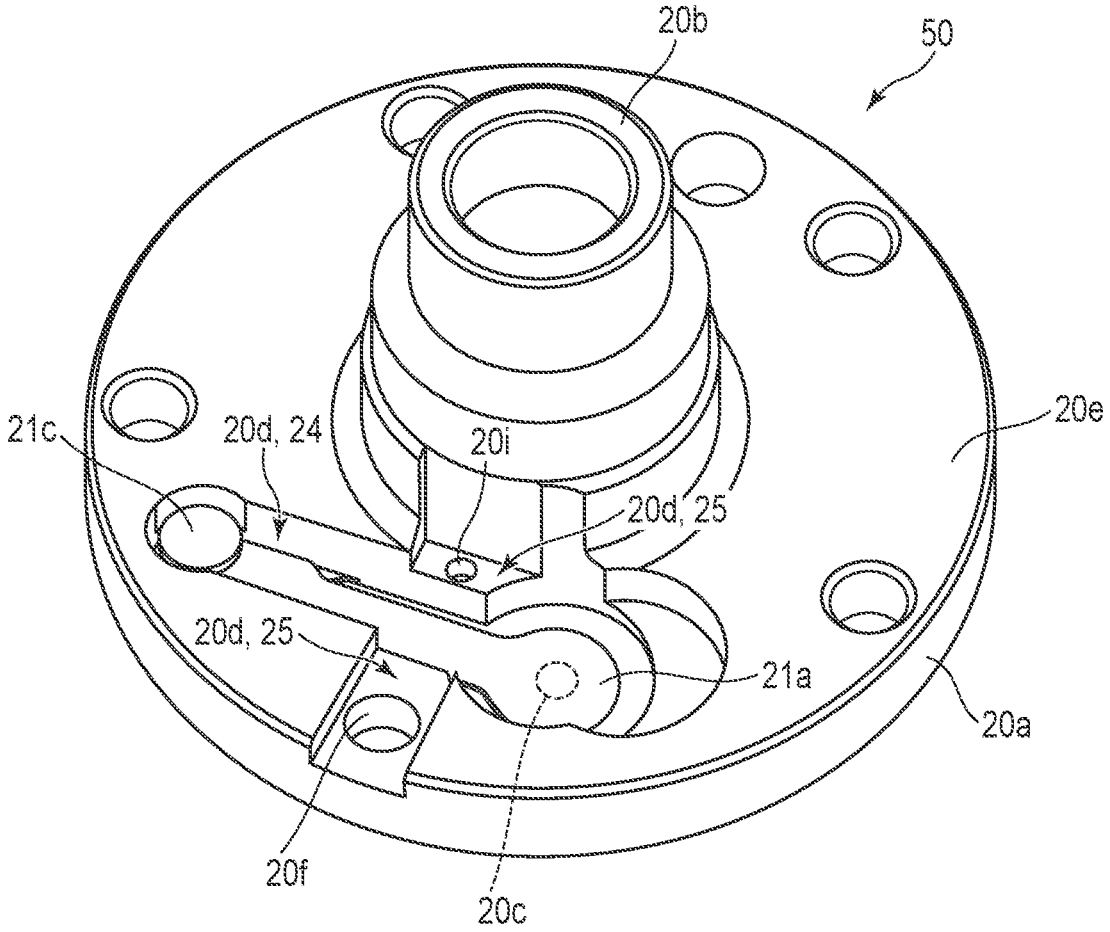
FIG. 9 is a perspective view schematically showing a state where only a discharge valve of the discharge valve mechanism (first discharge valve mechanism) is arranged in FIG. 8.
Figure 10:
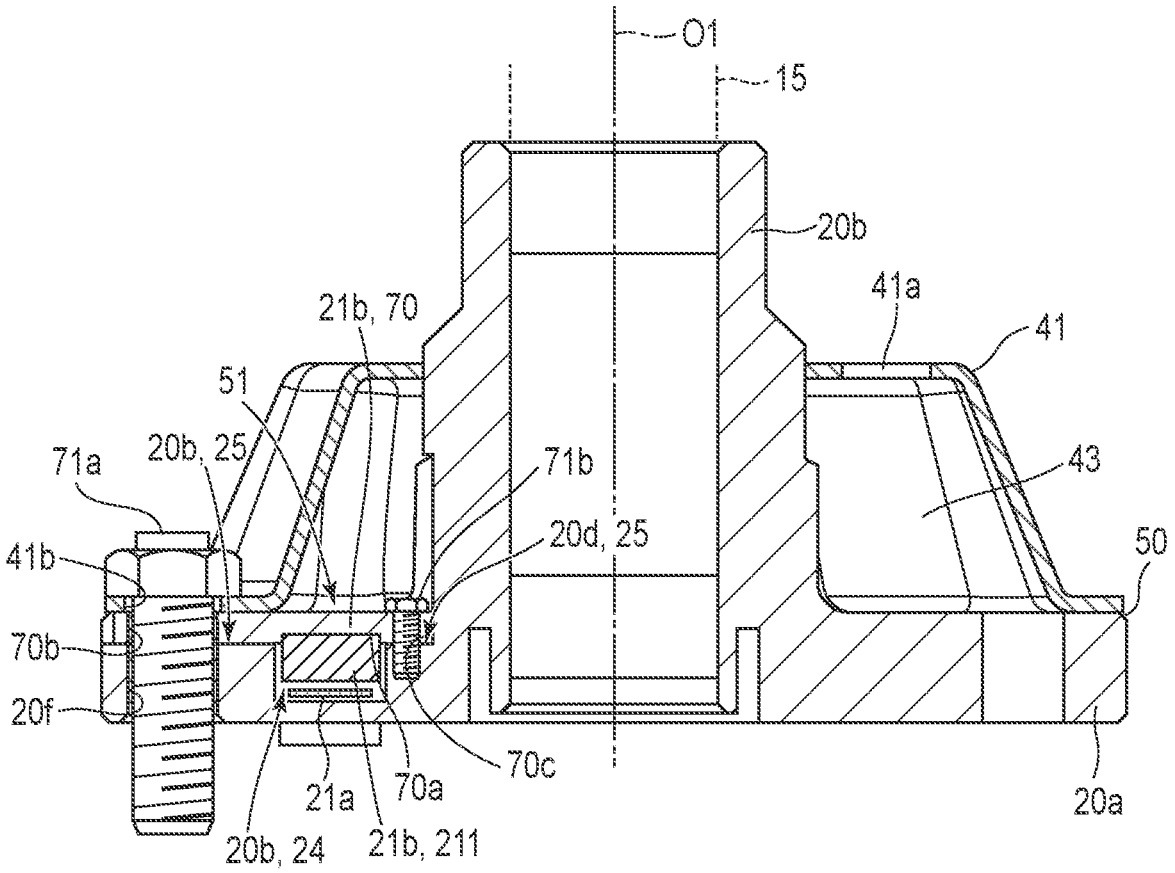
FIG. 10 is a view schematically showing a cross section of the bearing (first bearing) including the discharge valve mechanism (first discharge valve mechanism) according to the second embodiment.
Figure 11:
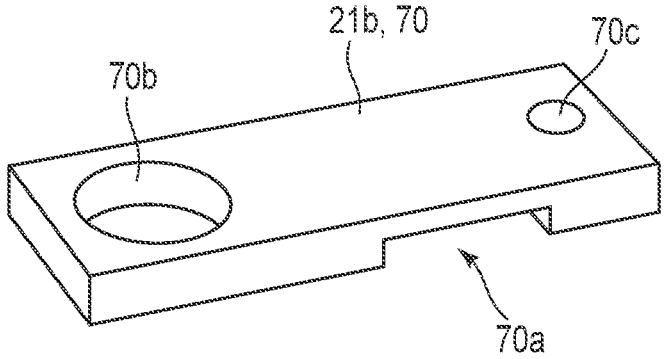
FIG. 11 is a perspective view schematically showing a fixed part (fixed piece) of a valve presser in the discharge valve mechanism (first discharge valve mechanism) according to the second embodiment.

In FIGS. 8 to 11, the configuration of a discharge valve mechanism according to this embodiment is shown. The aforementioned discharge valve mechanism is a valve mechanism (hereinafter referred to as a first discharge valve mechanism 51) corresponding to the first discharge valve mechanism 21 according to the first embodiment. FIG. 8 is a perspective view schematically showing a first bearing 50 including the first discharge valve mechanism 51. The first bearing 50 is the main bearing corresponding to the first bearing of the first embodiment. FIG. 9 is a perspective view schematically showing a state where only a discharge valve 21*a* of the first discharge valve mechanism 51 is arranged in FIG. 8. FIG. 10 is a cross-sectional view schematically showing the first bearing 50. FIG. 11 is a perspective view schematically showing a fixed piece 70 which is a fixed part of a valve presser 21*b* in the first discharge valve mechanism 51.

As shown in FIGS. 8 to 10, the first discharge valve mechanism 51 is provided in the first flange part 20*a* of the first bearing 50, appropriately opens a first discharge hole 20*c*, and discharges the refrigerant compressed in a compression chamber of a first cylinder 13. The first discharge valve mechanism 51 includes a discharge valve 21*a* and valve presser 21. The first discharge valve mechanism 51 is installed in a dug-down part 20*d* formed in the first flange part 20*a*. As in the case of the first embodiment, the dug-down part 20*d* is formed by digging down the top surface 20*e* of the first flange part 20*a* to a predetermined depth, and includes a first part 24 and second part 25 each of which is lengthwise in the predetermined direction. Further, likewise, the first discharge hole 20*c* is opened at a bottom of the dug-down part 20*d*.

In the first discharge valve mechanism 51, the configurations of the discharge valve 21*a* and valve presser piece 211 of the valve presser 21*b* are made identical to the first embodiment.

A fixed piece 70 is a fixed part of the valve presser 21*b* in the first discharge valve mechanism 51. The fixed part 70 is fixed to the first bearing 50, supports the valve presser piece 211, and enhances the strength of the first flange part 20*a* at the dug-down part 20*d*. As shown in FIG. 8, FIG. 10, and FIG. 11, the fixed piece 70 is configured separately from the valve presser piece 211 as a member lengthwise in the predetermined direction and having a thickness greater than the discharge valve 21*a* as in the case of the valve presser piece 211. That is, the valve presser 21*b* is configured by assembling the valve presser piece 211 and fixed piece 70 which are members separate from each other into the valve presser 21*b*. In this regard, the valve presser 21*b* of this embodiment is identical to the valve presser 21*b* according to the first embodiment. However, unlike the fixed piece 212, the fixed piece 70 includes only the part corresponding to the first piece 30*a* and includes no part corresponding to the second piece part 30*b* and no part corresponding to the reinforcing part 30*c*.

The fixed piece 70 has a plate-like shape lengthwise along the top surface 20*e* of the first flange part 20*a*. The fixed piece 70 is arranged in such a manner that the longitudinal direction thereof is made along the radial direction of the first flange part 20*a*, in other words, along the direction orthogonal to the central axis of the rotating shaft 15 in the plane including the central axis. That is, the longitudinal direction of the fixed piece 70 is parallel to the direction orthogonal to the central axis of the rotating shaft 15 in the plane including the central axis, i.e., parallel to the longitudinal direction of the second part 25 of the dug-down part 20*d*. The fixed part 70 includes a seating face part 70*a* configured to support the valve presser piece 211 thereon. The seating face part 70*a* is a flat face part formed by making a portion (of the fixed part 70) opposable to the valve presser piece 211 have a step relatively to the other portions. The seating face part 70*a* gets contact with the valve presser piece 211 from above, and holds the valve presser piece 211 down to support the valve presser piece 211. Further, the fixed piece 70 includes through-holes 70*b* and 70*c* into which bolts 71*a* and 71*b* are to be respectively inserted. Each of the bolts 71*a* and 71*b* is an example of a fixing member configured to fix the fixed piece 70 to the first flange part 20*a*. As shown in FIG. 9, the second part 25 of the dug-down part 20*d* includes a through-hole 20*f* into which the bolt 71*a* is to be inserted and bolt-hole 20*i* configured to fasten the bolt 71*b*.

As shown in FIG. 8, FIG. 10, and FIG. 11, the through-hole 70*b* is arranged at a position on the fixed piece 70 closer to one end thereof in the longitudinal direction thereof, and through-hole 70*c* is arranged at a position on the fixed piece 70 closer to the other end thereof in the longitudinal direction thereof. In this embodiment, the through-hole 70*b* is positioned on the first flange part 20*a* and closer to the outer circumference thereof in the radial direction thereof, and communicates with the through-hole 20*f*. The through-hole 70*c* is positioned on the first flange part 20*a* and closer to the inner circumference thereof in the radial direction thereof, and communicates with the bolt-hole 20*i*. Further, in this embodiment, the fixed piece 70 is fastened to the first cylinder 13 through the first flange part 20*a* with the bolt 71*a* together with the first muffler 41. In this regard, the fixed piece 70 is identical to the fixed piece 212 according to the first embodiment. On the other hand, unlike the first embodiment, the fixed piece 70 is fixed to the first flange part 20*a* with the bolt 71*b* too.

Accordingly, as shown in FIG. 10, the fixed piece 70 is fixed to the first bearing 20 at each of the two positions of the first flange part 20*a*. In other words, the fixed piece 70 is fixed to the first flange part 20*a* in the direction along the central axis of the rotating shaft with the bolts 71*a* and 71*b*. In the fixed state described above, the fixed piece 70 is, as in the case of the fixed piece 212, arranged so as to intersect the valve presser piece 211 at right angles, and supports the valve presser piece 211 along the radial direction of the first flange part 20*a*, in other words, along the direction orthogonal to the central axis of the rotating shaft 15 in the plane including the central axis.

As described above, according to this embodiment, it is possible for the fixed piece 70, when the rotating shaft 15 is rotated, to bear the burden of the force attempting to make the dug-down part 20*d* undergo elastic deformation so as to incline the first boss part 20*b* toward, for example, the first flange part 20*a*. That is, it is possible to make the fixed piece 70 function as a reinforcing member configured to enhance the strength of the first flange part 20*a* at the dug-down part 20*d*. Owing to this, it becomes possible to suppress the elastic deformation of the dug-down part 20*d* and slantwise deformation of the first boss part 20*b*, and reduce the noise caused by, for example, the rotating shaft 15 creating bending vibration.

It should be noted that for the same reason as the first embodiment described above, it becomes possible, in the valve mechanism of this embodiment corresponding to the second discharge valve mechanism 23, to omit the member corresponding to the fixed piece 70. In this case, the aforementioned valve mechanism can be configured in the same manner as the first discharge valve mechanism 51 except for the differences incidental to the point that the aforementioned valve mechanism has no member corresponding to the fixed piece 70 and point that the aforementioned valve mechanism is positioned opposite (upside down) in the vertical direction to the first discharge valve mechanism 51.

Third Embodiment

Figure 12:
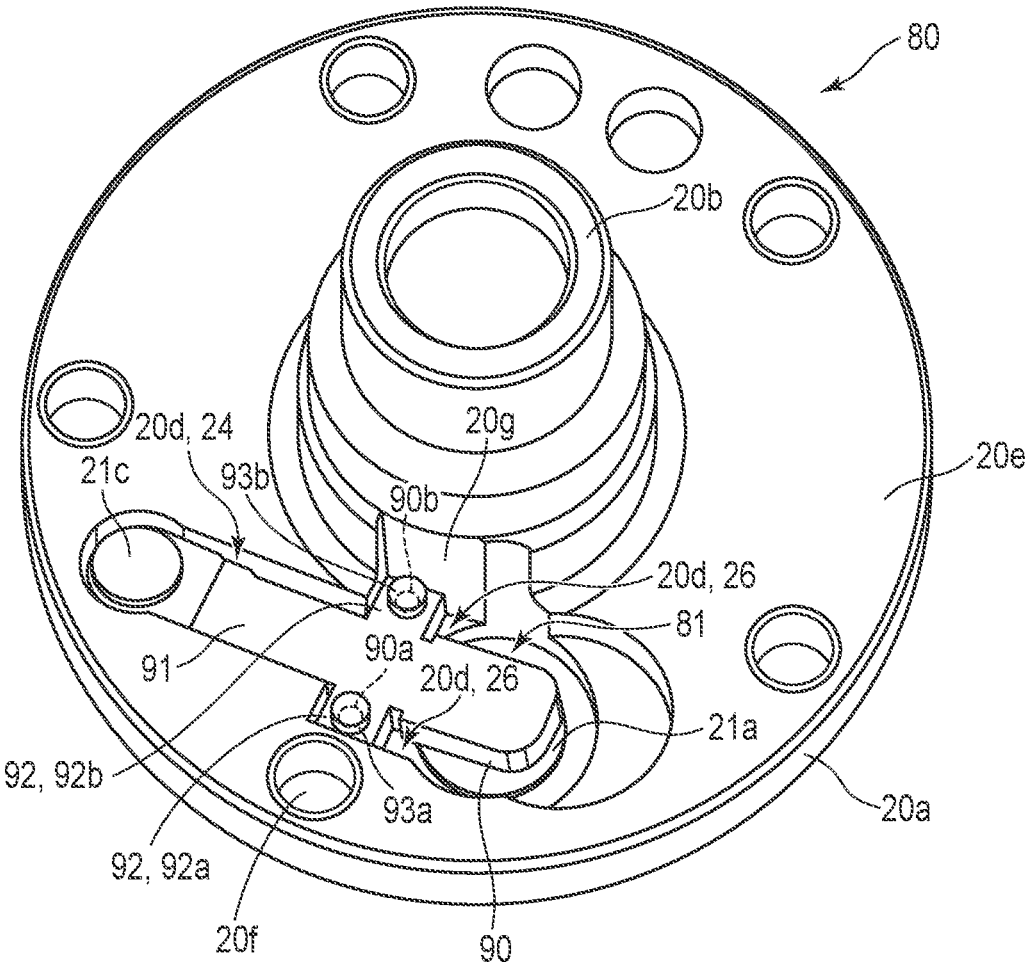
FIG. 12 is a perspective view schematically showing a bearing (first bearing) including a discharge valve mechanism (first discharge valve mechanism) according to a third embodiment.
Figure 13:
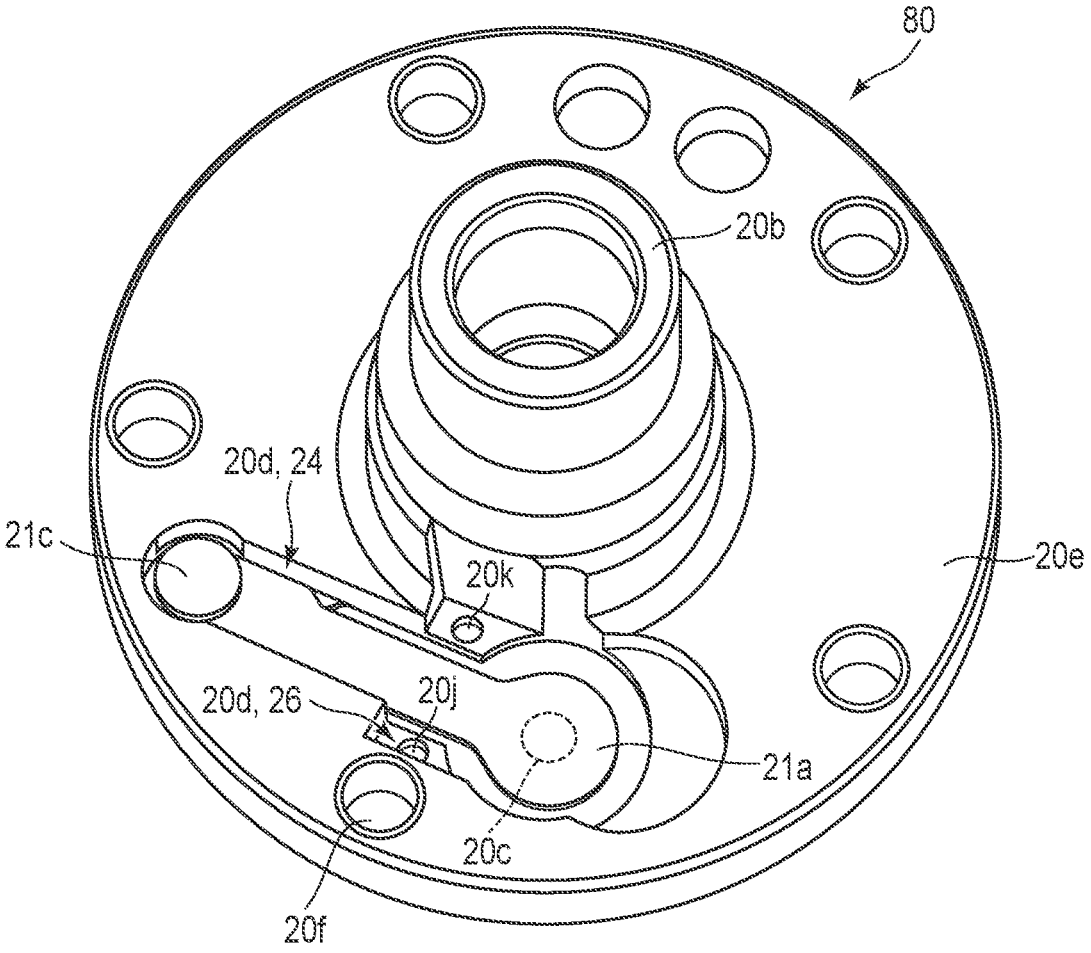
FIG. 13 is a perspective view schematically showing a state where only a discharge valve of the discharge valve mechanism (first discharge valve mechanism) is arranged in FIG. 12.
Figure 14:
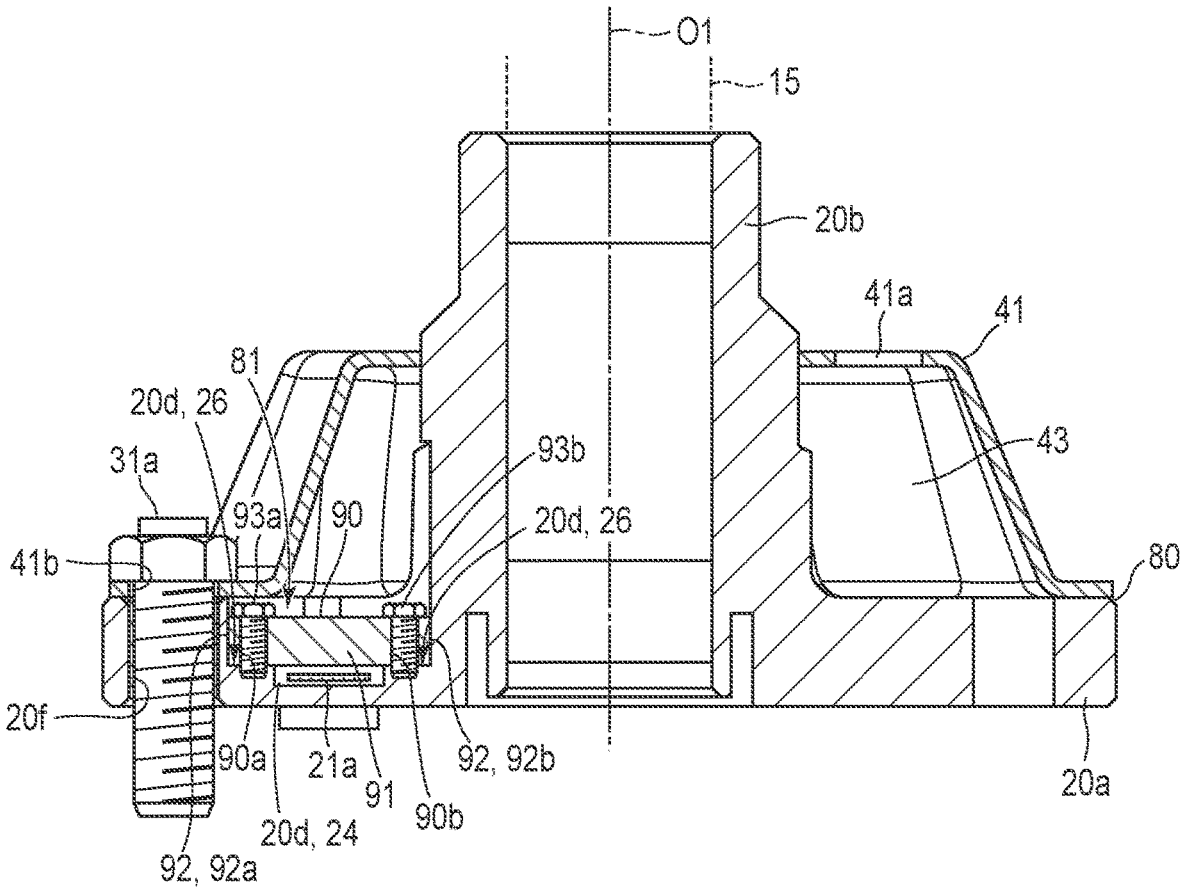
FIG. 14 is a view schematically showing a cross section of the bearing (first bearing) including the discharge valve mechanism (first discharge valve mechanism) according to the third embodiment.
Figure 15:
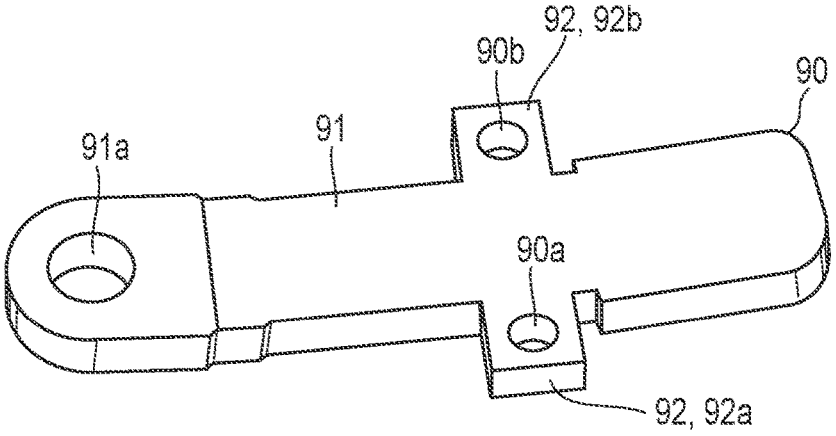
FIG. 15 is a perspective view schematically showing a valve presser (main body part and fixed part) in the discharge valve mechanism (first discharge valve mechanism) according to the third embodiment.

In FIGS. 12 to 15, the configuration of a discharge valve mechanism according to this embodiment is shown. The aforementioned discharge valve mechanism is a valve mechanism (hereinafter referred to as a first discharge valve mechanism 81) corresponding to the first discharge valve mechanism 21 according to the first embodiment. FIG. 12 is a perspective view schematically showing a first bearing 80 including a first discharge valve mechanism 81. The first bearing 80 is a main bearing corresponding to the first bearing according to the first embodiment. FIG. 13 is a perspective view schematically showing a state where only a discharge valve 21*a* of the first discharge valve mechanism 81 is arranged in FIG. 12. FIG. 14 is a cross-sectional view schematically showing the first bearing 80. FIG. 15 is a perspective view schematically showing a valve presser 90 in the first discharge valve mechanism 81.

As shown in FIGS. 12 to 15, the first discharge valve mechanism 81 is provided in the first flange part 20*a* of the first bearing 80, appropriately opens a first discharge hole 20*c*, and discharges the refrigerant compressed in a compression chamber of a first cylinder 13 from the compression chamber. The first discharge valve mechanism 81 includes a discharge valve 21*a* and valve presser 90. The first discharge valve mechanism 81 is installed in a dug-down part 20*d* formed in the first flange part 20*a*. As in the case of the first embodiment, the dug-down part 20*d* is formed by digging down the top surface 20*e* of the first flange part 20*a* to a predetermined depth, and includes a first part 24 and second part 26 each of which is lengthwise in the predetermined direction. The first part 24 and second part 26 are arranged in such a manner that the longitudinal directions of the first and second parts 24 and 26 are made to intersect each other. In the example shown in FIGS. 12 to 14, the longitudinal directions of the first part 24 and second part 26 are made to intersect each other at right angles. The longitudinal direction of the second part 26 is a radial direction of the first flange part 20*a*, in other words, a direction orthogonal to the central axis of the rotating shaft 15 in the plane including the central axis. The longitudinal direction of the first part 24 is a direction orthogonal to the radial direction of the first flange part 20*a*, in other words, a direction orthogonal to the plane including the central axis of the rotating shaft 15. The first discharge hole 20*c* is opened at the bottom of the dug-down part 20*d*.

In the first discharge valve mechanism 81, the configuration of the discharge valve 21*a* is made identical to the first embodiment.

As shown in FIG. 15, the valve presser 90 includes a main body part 91 and fixed part 92 and these parts are configured as one member constituting one body. That is, each of the main body part 91 and fixed part 92 corresponds to a part of the valve presser 90 configured as one member.

The main body part 91 has a plate-like shape lengthwise along the top surface 20*e* of the first flange part 20*a*. The longitudinal direction of the main body part 91 is the direction along the longitudinal direction of the discharge valve 21*a*. The main body part 91 is arranged in such a manner that the longitudinal direction thereof is made along the direction orthogonal to the radial direction of the first flange part 20*a*, in other words, along the direction orthogonal to the plane including the central axis of the rotating shaft 15. That is, the longitudinal direction of the main body part 91 is parallel to the direction orthogonal to the plane including the central axis of the rotating shaft 15, i.e., parallel to the longitudinal direction of the first part 24 of the dug-down part 20*d*. One end of the main body part 91 in the longitudinal direction thereof is fixed to the first flange part 20*a* with a fixing member 21*c* together with the discharge valve 21*a*. Further, the main body part 91 includes a through-hole 91*a* into which the fixing member 21*c* is to be inserted.

The fixed part 92 is a part continuous with the main body part 91, extending from the main body part 91, and fixed to the first bearing 80. In the example shown in FIG. 15, the fixed part 92 forms a pair, and the paired parts outwardly extend in directions opposite to each other from the vicinity of the intermediate part of the main body part 91 in the longitudinal direction thereof. That is, the fixed part 92 outwardly extends in the directions intersecting the longitudinal direction of the discharge valve 21*a* relatively to the main body part 91, in other words, in the directions intersecting the longitudinal direction of the main body part 91. Each of the fixed parts 92*a* and 92*b* is perpendicularly continuous with the main body part 91. The fixed parts 92*a* and 92*b* are arranged in the radial direction of the first flange part 20*a*, in other words, in the direction orthogonal to the central axis of the rotating shaft 15 in the plane including the central axis. That is, the extension direction of the fixed parts 92*a* and 92*b*, to put it plainly, the longitudinal direction of the fixed part 92 is parallel to the direction orthogonal to the central axis of the rotating shaft 15 in the plane including the central axis, i.e., parallel to the longitudinal direction of the second part 26 of the dug-down part 20*d*.

Further, the fixed parts 92*a* and 92*b* respectively include through-holes 90*a* and 90*b* into which bolts 93*a* and 93*b* are to be respectively inserted. Each of the bolts 93*a* and 93*b* is an example of a fixing member configured to fix each of the fixed parts 92*a* and 92*b* to the first flange part 20*a*. As shown in FIG. 13, the second part 26 of the dug-down part 20*d* includes bolt-holes 20*j* and 20*k* configured to fasten the bolts 93*a* and 93*b*. The through-holes 90*a* and 90*b* are respectively arranged at the fixed parts 92*a* and 92*b*. In this embodiment, the through-hole 90*a* is positioned on the first flange part 20*a* and closer to the outer circumference thereof in the radial direction thereof, and communicates with the bolt-hole 20*j*. The through-hole 90*b* is positioned on the first flange part 20*a* and closer to the inner circumference thereof in the radial direction thereof, and communicates with the bolt-hole 20*k*.

Accordingly, as shown in FIG. 14, the fixed part 92 is fixed to the first bearing 80 at each of the two positions of the first flange part 20*a*. In other words, the fixed part 92 is fixed to the first flange part 20*a* in the direction along the central axis of the rotating shaft with the bolts 93*a* and 93*b*. In the fixed state described above, the fixed part 92 is arranged so as to intersect the main body part 91 at right angles, and supports the main body part 91 along the radial direction of the first flange part 20*a*, in other words, along the direction orthogonal to the central axis of the rotating shaft 15 in the plane including the central axis. That is, the valve presser 90 is supported along the radial direction of the first flange part 20*a*, in other words, along the direction orthogonal to the central axis of the rotating shaft 15 in the plane including the central axis.

As described above, according to this embodiment, it is possible for the fixed part 92, when the rotating shaft 15 is rotated, to bear the burden of the force attempting to make the dug-down part 20*d* undergo elastic deformation so as to incline the first boss part 20*b* toward, for example, the first flange part 20*a*. That is, it is possible to make the valve presser 90 function as a reinforcing member configured to enhance the strength of the first flange part 20*a* at the dug-down part 20*d*. Owing to this, it becomes possible to suppress the elastic deformation of the dug-down part 20*d* and slantwise deformation of the first boss part 20*b*, and reduce the noise caused by, for example, the rotating shaft 15 creating bending vibration.

It should be noted that for the same reason as the first embodiment described above, it becomes possible, in the valve mechanism of this embodiment corresponding to the second discharge valve mechanism 23, to omit the part corresponding to the fixed part 92 of the valve presser 90. In this case, the aforementioned valve mechanism can be configured in the same manner as the first discharge valve mechanism 81 except for the differences incidental to the point that the aforementioned valve mechanism has no fixed part corresponding to the fixed part 92 and point that the aforementioned valve mechanism is positioned opposite (upside down) in the vertical direction to the first discharge valve mechanism 81.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A compressor comprising:

cylinders which compress a refrigerant;

a rotating shaft arranged inside the cylinders and including eccentric parts;

bearings each of which includes a flange part defining a surface in the cylinder in an axial direction of the rotating shaft, and a boss part extending in a cylindrical form concentric with the rotating shaft so as to be continuous with the flange part and rotatably supporting the rotating shaft; and at least one of discharge valve mechanisms which is arranged in the flange part and includes a discharge valve deformed to be opened when the refrigerant compressed by the cylinder reaches a predetermined discharge pressure and lengthwise in a predetermined direction, and a valve presser suppressing further deformation of the discharge valve when the discharge valve is opened, wherein regarding the valve pressers, each of the valve pressers includes a main body part lengthwise along a longitudinal direction of the discharge valve, and at least one of the valve pressers includes a fixed part extending in a direction intersecting the longitudinal direction of the discharge valve relatively to the main body part and fixed to the bearing.

2. The compressor of claim 1, wherein the fixed part includes a first piece part to be fixed to the flange part.

3. The compressor of claim 2, wherein the fixed part further includes a second fixed piece part configured to be continuous with the first piece part and fixed to the boss part.

4. The compressor of claim 2, further comprising mufflers each of which is attached to bearing and forms a muffler chamber into which the refrigerant compressed by the cylinder is discharged between the flange part and the boss part, wherein the first piece part is fixed to the flange part with a bolt together with a part of the muffler chamber.

5. The compressor of claim 1, wherein in the flange part, a concave part in which the discharge valve mechanism is to be installed is formed, the concave part includes a first part and a second part arranged in such a manner that longitudinal directions of the first part and the second part are made to intersect each other, and the longitudinal direction of the first part is parallel to the longitudinal direction of the main body part, and the longitudinal direction of the second part is parallel to the longitudinal direction of the fixed part.

6. An air conditioner comprising:

a compressor of claim 1;

a condenser connected to the compressor;

an expanding device connected to the condenser; and an evaporator connected to the expanding device.

* * * * *